US005964084A

United States Patent [19]

Wassenhoven et al.

[11] Patent Number: 5,964,084

[45] Date of Patent: Oct. 12, 1999

[54] OPEN-END SPINNING DEVICE

[75] Inventors: Heinz-Georg Wassenhoven, Moenchengladbach; Bert Schlomer; Lothar Winzen, both of Heinsberg, all of Germany

[73] Assignee: W. Schlafhorst AG & Co., Moenchengladbach, Germany

[21] Appl. No.: 09/066,686

[22] Filed: Apr. 27, 1998

[30] Foreign Application Priority Data

May 7, 1997 [DE] Germany ..... 197 19 279

[51] Int. Cl.[6] ..... D01H 4/00

[52] U.S. Cl. ..... 57/406; 57/78; 57/104; 57/263; 57/404

[58] Field of Search ..... 57/406, 407, 263, 57/404, 78, 88, 135, 104

[56] References Cited

U.S. PATENT DOCUMENTS

| | | | |
|---|---|---|---|
| 3,805,506 | 4/1974 | Stahlecker | 57/406 |
| 3,838,560 | 10/1974 | Stahlecker | 57/406 |
| 3,868,815 | 3/1975 | Stahlecker | 57/88 |
| 4,041,688 | 8/1977 | Stahlecker | 57/406 |
| 4,703,616 | 11/1987 | Feuchter et al. | 57/406 |
| 4,763,465 | 8/1988 | Raasch | 57/406 |
| 4,785,620 | 11/1988 | Feuchter | 57/88 |
| 4,989,401 | 2/1991 | Feuchter et al. | 57/406 |
| 5,483,034 | 1/1996 | Havard et al. . | |

FOREIGN PATENT DOCUMENTS

| | | | |
|---|---|---|---|
| 254 963 A1 | 3/1988 | German Dem. Rep. . | |
| 2910814 | 10/1980 | Germany | 57/78 |
| 32 47 411 C2 | 2/1994 | Germany . | |
| 43 43 859 A1 | 1/1995 | Germany . | |
| 2089847 | 6/1982 | United Kingdom | 57/406 |

*Primary Examiner*—William Stryjewski
*Attorney, Agent, or Firm*—Kennedy Covington Lobdell & Hickman, LLP

[57] ABSTRACT

An open-end spinning device (1) has a spinning rotor (2) supported by its rotor shaft (3) in the bearing wedges (4, 4') of a supporting plate bearing (5). A rotor brake (12) arranged in the area of the supporting plate bearing (4) has brake elements (13) operable vertically downwardly on the rotor shaft (3). The brake elements (13) of the rotor brake (12) are arranged centered above the respective bearing wedges (4, 4') of the supporting plate bearing (5) and are seated in a box-like component (14) to be linearly displaced in the vertical direction (R).

8 Claims, 3 Drawing Sheets

OPEN-END SPINNING DEVICE

FIELD OF THE INVENTION

The present invention relates generally to an open-end spinning device with a spinning rotor which is supported by means of its rotor shaft in the bearing wedge of a supporting plate bearing, and more particularly to a rotor brake for such an open-end spinning device having a brake element which rests on the rotor shaft from above in the braking position to be applied to the rotor shaft.

BACKGROUND OF THE INVENTION

Such open-end spinning devices are, for example, known from German Patent Publication DE 25 55 059 C2, which discloses a typical open-end spinning unit with a rotor revolving in a rotor housing to which the present invention is applicable. The rotor housing is closed by means of a cover forming a part of a spinning box housing assembly which can be pivoted downward around a pivot shaft for exposing the spinning rotor. In the closed position, i.e. during the spinning process, this housing element is secured by a locking lever.

In this device, the locking lever has a guide surface which is almost concentric in respect to the pivot axis of the housing element and against which a locking roller disposed on the housing element rolls when the housing assembly is pivoted out of its operating position into an unlocking position. In the process, the locking roller maintains the locking lever in the unlocked position, as well as keeping a braking device in a braking position.

The braking device consists of a pivotably seated double lever, which has a brake element at the end of one of its sides. The lever is disposed to be placed on the rotor shaft in the area between the supporting plate bearing wedges. The double lever is furthermore acted upon in the brake release direction by means of a spring element, which acts on the other end of the double lever. The double lever is additionally connected with the locking lever by means of a brake cable such that the brake element is automatically pushed on the rotor shaft when the locking lever is actuated.

Open-end spinning devices designed in this manner are disadvantageous for various reasons. For example, the point of application of the rotor brake between the bearing wedges results in the application of an additional bending moment to the rotor shaft revolving at high rpm. In addition, the danger arises with such a location for applying the brake element that over time the running area of the rotor shaft, i.e. the area in which the rotor shaft rotates on the supporting plates, becomes dirty. It has been shown, in particular with processing synthetic fibers, that over time a mixture of fiber finishes, fiber debris and dust becomes lodged in the area between the running surfaces of the supporting plates and the rotor shaft which can cause an irregular running of the rotor and may have a very disadvantageous effect on the spinning result as well as on the service life of the spinning device.

Therefore a rotor brake has already been proposed in German Patent Publication DE 36 30 256 A1, which avoids the above mentioned problem of the running surfaces becoming soiled. This known rotor brake has a brake shoe arranged between the pairs of supporting plates to be placed from below against the rotor shaft, as well as two hold-down pads which act parallel and can be placed obliquely from above against the rotor shaft in the running area of the supporting plates and the rotor shaft.

All possible deposits are scraped off the rotor shaft in the running area of the rotor shaft by means of the friction of the hold-down pads. Since the rotor is braked after each yarn break, after each bobbin change, and possibly at regularly timed intervals, and since cleaning of the rotor shaft automatically takes place during braking, no more soiling, which would have an interfering effect, can occur at the rotor shaft.

Although the rotor braking device in accordance with German Patent Publication DE 36 30 256 A1 has proven itself in actual use, the device having a brake shoe which can be placed against the rotor shaft from below, as well as two oppositely acting hold-down devices, is very expensive from the viewpoint of its structural design.

SUMMARY OF THE INVENTION

Based on the above mentioned prior art, it is an object of the present invention to improve the known rotor braking devices for open-end spinning machines.

The present invention is basically applicable to essentially any open-end spinning device comprising a spinning rotor having a rotor shaft and a supporting plate bearing having two spaced pair of rotatable plates defining wedge-like gaps therebetween in which the rotor shaft is rotatably supported. In accordance with the present invention, the foregoing object is attained by providing the open-end spinning device with a rotor brake having two brake elements arranged above the wedge-like gaps of the supporting plate bearing and downwardly engagable with an upper surface of the rotor shaft for braking of the rotor shaft.

This rotor brake design in accordance with the invention has the advantage that the rotor brake, although it is simple in design and therefore cost-effective, not only provides a good braking effect, but also always cleans the running areas of the rotor shaft automatically and dependably in the course of the braking operation.

An advantageous structural design of the rotor brake provides for the brake elements to be seated to be linearly displaceable and to act vertically on the rotor shaft in the area of the bearing wedges of the supporting plate bearing, whereby it is possible to prevent not only the introduction of additional bending moments into the rotor shaft but also to assure dependable cleaning of the running areas. In addition, the linearly displaceable, vertically acting brake elements prevent additional lateral force components from acting on the rotor shaft during braking, which usually occurs in the prior art.

In a preferred embodiment, the brake elements are arranged in a box-like brake element support component, which is seated to be vertically displaceable with a degree of play between the walls of a bearing bracket. Such an embodiment results in a compact, very stiff braking device which, if necessary, can also transfer larger braking forces without problems.

The box-like component advantageously has lateral wall sections, into which elongated hole guides are cut. These elongated hole guides cooperate with guide bolts fixed in the walls of the bearing bracket. In this embodiment, the guide bolts, together with the elongated holes, constitute a vertical guide device which, on the one hand, assures a sufficiently accurate guidance of the box-like component between the walls of the bearing bracket and, on the other hand makes sure that the box-like component, and thus the rotor brake, remains able to function even in case of increased deposits of fiber fluff and/or finishes. Thus, it is assured by means of this guide device having relatively large play that the braking device always remains ready for operation, even under difficult operating conditions, such as occur in spinning mills.

In accordance with another feature of the invention, the box-like component is acted upon at the bottom by a spring element, for example a helical spring, to urge the box-like component in the brake release direction. Furthermore, the spring element always maintains the box-like component in contact with an angled lever and free of play. The angled lever in turn is connected to a brake lever. By means of the play-free contact of the angled lever with the box-like component it is assured that the braking device always reacts without delay.

Preferably, the brake comprises a brake lever pivotably supported on the bracket of the supporting plate bearing and the spring is disposed between the brake element support component and the brake lever. The brake further includes an angled lever pivotably mounted to the bracket of the supporting plate bearing, one end of the angled lever being connected to the brake lever and an opposite free end of the angled lever being arranged to act upon the brake element support component.

Further advantageous embodiments and features of the present invention will be understood from an exemplary embodiment described below with reference to the accompanying drawings.

DETAILED DESCRIPTION OF THE PREFERRED EMBODIMENT

Figure 1:
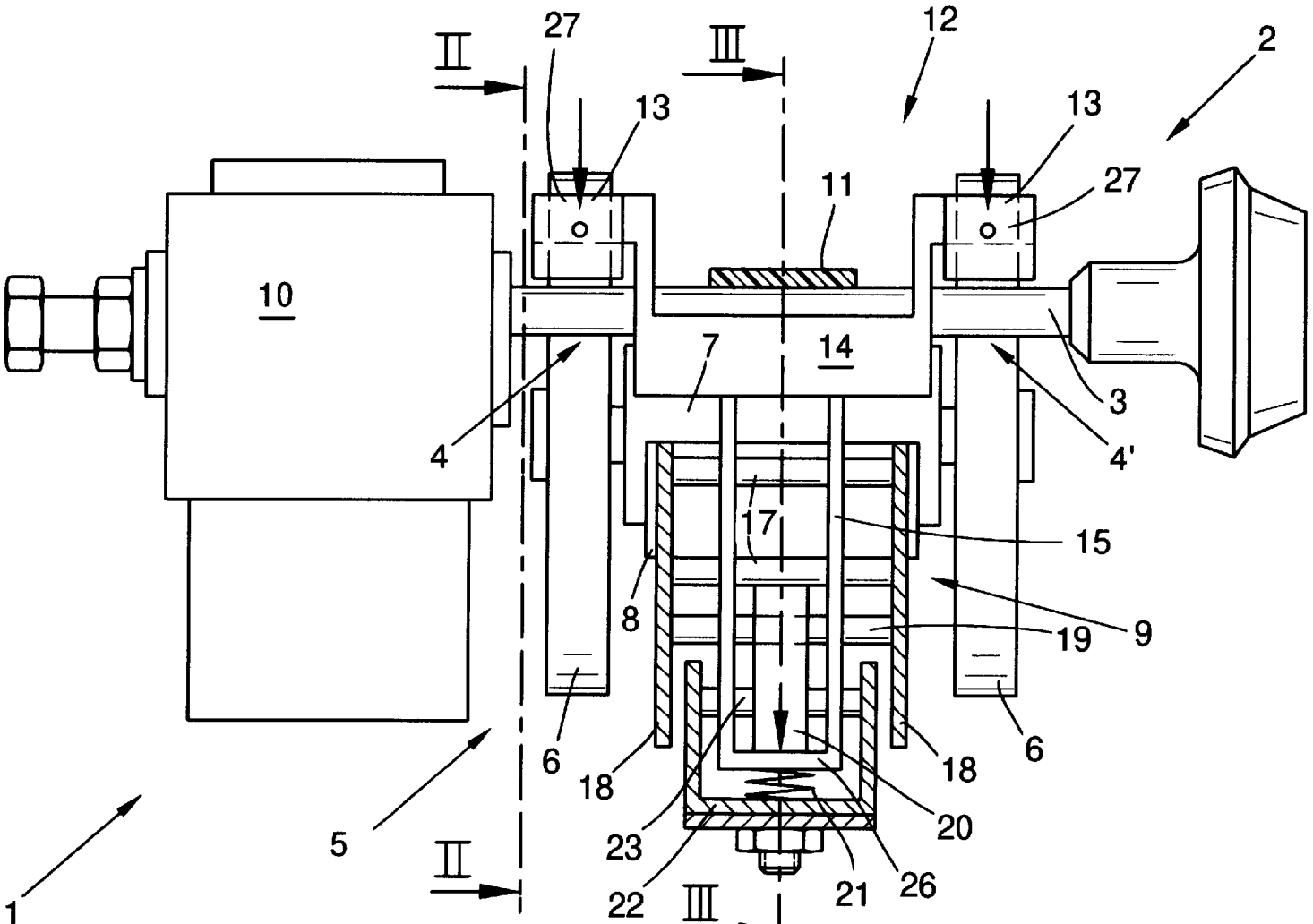
FIG. 1 is a side elevational view of a supporting plate bearing of an open-end rotor spinning device with a switchable rotor brake in accordance with a preferred embodiment of the present invention.

Referring now to the accompanying drawings and initially to FIG. 1, a known form of supporting plate bearing assembly is identified generally at 5 in an open-end rotor spinning device, identified as a whole by 1. As usual, the spinning rotor 2 is supported by its rotor shaft 3 in the bearing wedges 4, 4' formed between two spaced pairs of supporting plates 6, 6' of the supporting plate bearing assembly 5. For the sake of clarity, FIG. 1 only shows one pair 6 of supporting plates.

Figure 2:
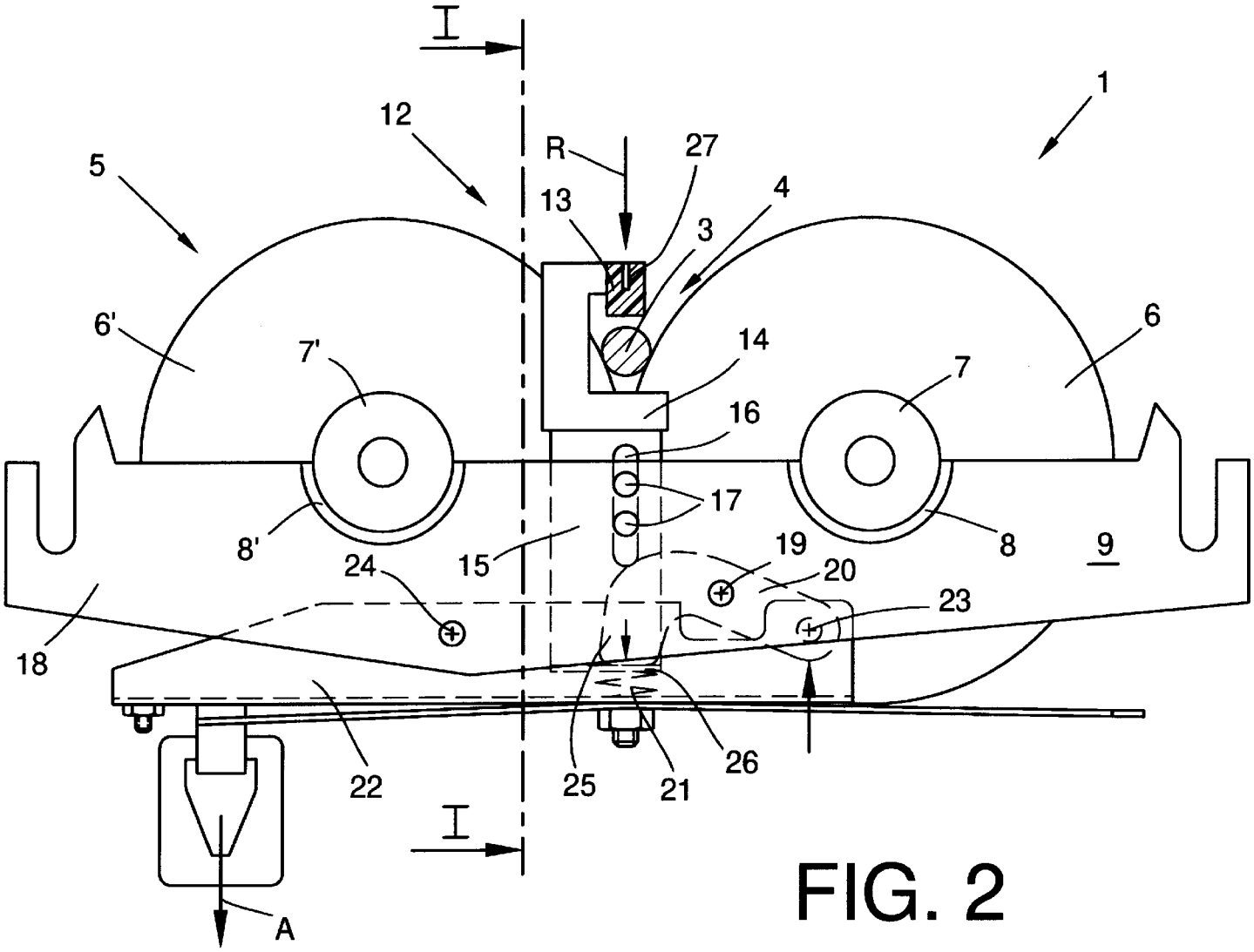
FIG. 2 is a cross-sectional view of the supporting plate bearing in accordance with FIG. 1, taken along section line II—II thereof.

FIG. 2 shows the two pairs 6 and 6' of supporting plates respectively positioned with their bearing bodies 7, 7' in receptacles 8, 8' of a bearing bracket 9, and fixed in place in such disposition by fastening means (not represented).

As shown in FIG. 1, the rotor shaft 4 is supported at its end in an axial bearing 10. The drive of the open-end rotor spinning device 1 takes place via a tangential belt 11 acting on the rotor shaft 3.

Figure 3:
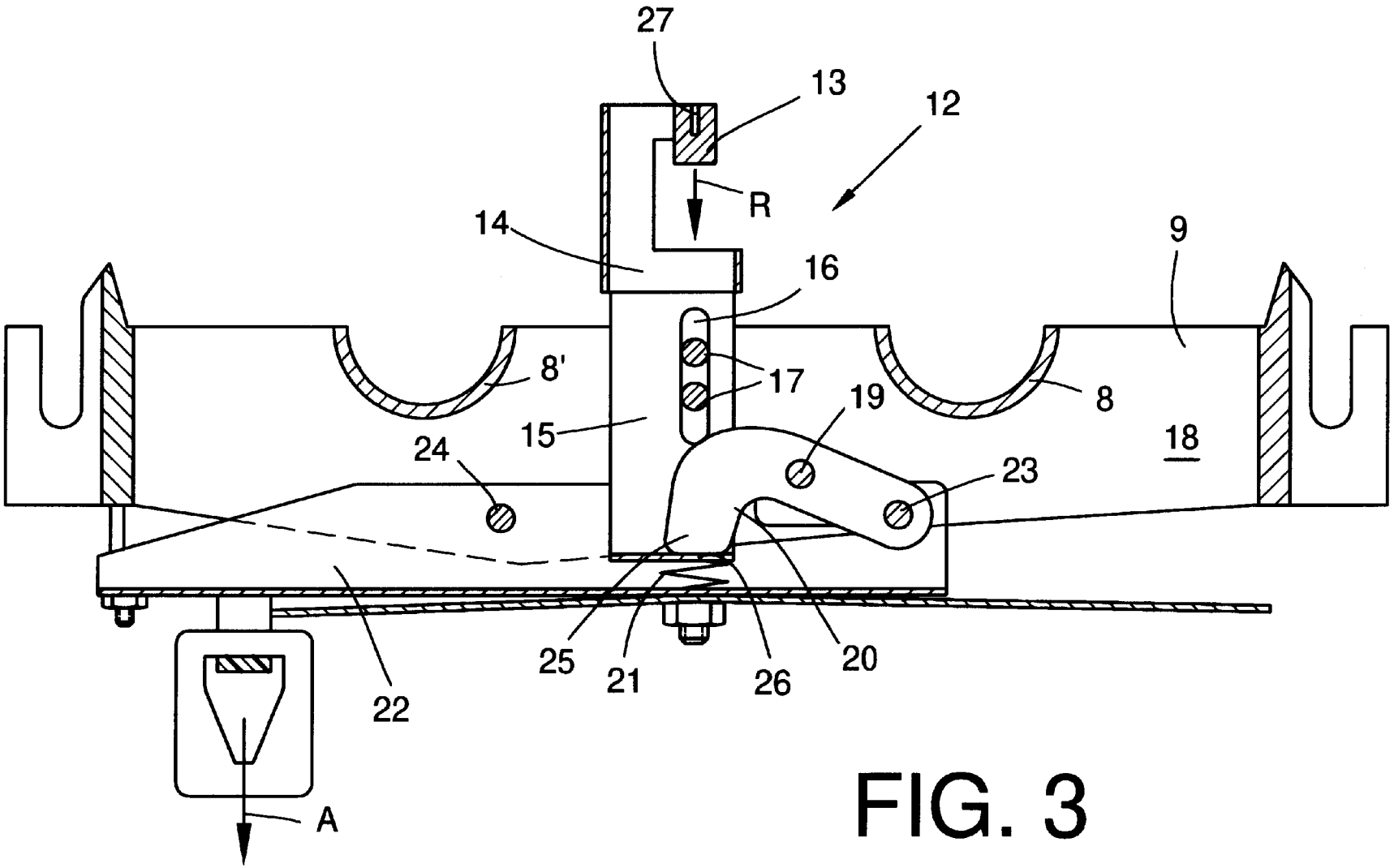
FIG. 3 is another cross-sectional view of the supporting plate bearing in accordance with FIG. 1, taken along section line III—III thereof.

A rotor brake 12 is disposed in the area between the bearing wedges 4, 4' of the supporting plate bearing 5 and basically comprises a box-like component 14 with spaced projections 27 on each of which a brake element 13 is fixed. As can be seen in particular in FIGS. 2 and 3, the box-like component 14 has housing walls 15 each of which has elongated hole guides 16 which, together with guide bolts 17, constitute a vertical guide. The guide bolts 17 are fixed in the walls 18 of the bearing bracket 9. In addition, an angled lever 20 is seated by means of a pivot bolt 19 in the wall 18 of the bearing bracket 9 and is connected via a connecting bolt 23 with a brake lever 22. In turn, the brake lever is seated on a pivot shaft 24 on the bearing bracket 9 for a limited degree of rotatability thereabout.

The angled lever 20 has a free end 25 opposite the end attached by the connecting bolt 23, which free end 25 acts on the bottom 26 of the box-like component 14. A spring element 21 is interposed between the brake lever 22 and the bottom 26 of the box-like- component 14, which continuously acts on the box-like component 14 in a direction lifting or separating the box-like component 14 from the brake lever 22 and therefore serves to release the brake.

The functioning of the device may thus be understood. Usually, modern open-end rotor spinning machines are serviced by at least one piecing carriage during the spinning process, which can be moved along the spinning stations and acts automatically in case of required service. Thus, when a service call, for example a yarn break, occurs at one of the multiple spinning devices of an open-end spinning machine, which for example requires the opening of the spinning device, the piecing carriage initially is positioned at this spinning station. Then, the piecing carriage actuates an unlocking lever at the respective spinning station by means of a corresponding device in such a way that the spinning box is opened. Specifically, the cover of the spinning device is transferred into a cleaning position by the piecing carriage. In the course of pivoting the cover, the brake lever 22, which is pivotably seated on the bearing bracket 9 of the supporting plate bearing 5, is also acted upon by the unlocking lever in the direction A and in the process is pivoted around the shaft 24. The pivoting movement of the brake lever 22 is transferred via the connecting bolt 23 to the angled lever 20 connected with the brake lever 22, so that it is also pivoted and with its free end 25 pushes against the bottom 26 of the box-like component 14 supporting the brake elements 13. In the process, the component 14, which is vertically displaceable by means of the guide formed by the guide bolts 17 in the elongated holes 16, is moved linearly downward in the direction R against the force of the spring element 21, so that the brake elements 13 arranged on the projections 27 of the component 14 are placed against the rotor shaft 3 in the area of the bearing wedges 4, 4' and brake the spinning rotor 2 to a stop. In the course of such braking action, a dependable cleaning of the running areas of the rotor shaft 3 also automatically takes place by means of the brake element 13 resting on the rotor shaft.

As a whole, the device in accordance with the invention constitutes a functionally dependable, cost-efficient braking device, which does not transfer any bending moments or lateral force components to the rotor shaft. In addition, its brake elements serves to maintain the running area of the rotor shaft, i.e. the area in which the rotor shaft rests on the supporting plate bearing, free of deposits.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intendent or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device comprising a spinning rotor having a rotor shaft, a supporting plate bearing having two spaced pair of rotatable plates defining wedge-like gaps therebetween in which the rotor shaft is rotatably supported, and a rotor brake having two brake elements respectively arranged above the wedge-like gaps of the supporting plate bearing and downwardly engagable with an upper surface of the rotor shaft at essentially the same respective locations axially therealong as the wedge-like gaps for braking of the rotor shaft substantially without imposing a bending moment thereon.

2. The open-end spinning device in accordance with claim 1, wherein the brake elements are selectively movable vertically into and out of braking engagement with the rotor shaft in the area of the wedge-like gaps.

3. The open-end spinning device in accordance with claim 2, wherein the supporting plate bearing comprises a bracket having spaced walls and the rotor brake comprises a brake element support component mounted for vertical displaceability with a predetermined degree of play between the walls of the bracket.

4. The open-end spinning device in accordance with claim 3, wherein the brake element support component comprises vertical wall sections having elongated holes formed therein and the spaced walls of the bracket of the supporting plate bearing have guide bolts extending into the elongated holes for guiding vertical movement of the brake element support component.

5. The open-end spinning device in accordance with claims 3, wherein the brake comprises a spring urging the brake element support component toward a brake release position.

6. The open-end spinning device in accordance with claim 5, wherein the brake comprises a brake lever pivotably supported on the bracket of the supporting plate bearing and the spring is disposed between the brake element support component and the brake lever.

7. The open-end spinning device in accordance with claim 6, wherein the brake comprises an angled lever pivotably mounted to the bracket of the supporting plate bearing, one end of the angled lever being connected to the brake lever and an opposite free end of the angled lever being arranged to act upon the brake element support component.

8. The open-end spinning device in accordance with claim 5, wherein the brake comprises a brake lever and the spring is disposed between the brake element support component and the brake lever.

* * * * *